US008136637B2

(12) United States Patent
Coquerelle et al.

(10) Patent No.: US 8,136,637 B2
(45) Date of Patent: Mar. 20, 2012

(54) SAFETY DEVICE FOR SECURING MINIMUM SPACES AT THE TOP OR BOTTOM OF AN ELEVATOR SHAFT BEING INSPECTED, AND ELEVATOR HAVING SUCH SAFETY DEVICES

(75) Inventors: Thomas Coquerelle, Douai (FR); Frédéric Beauchaud, Coullons (FR); Nicolas Fonteneau, Germiny des Pres (FR); Dominique Goulet, Chatillon sur Loire (FR); Olivier Dukacz, Les Choux (FR); Gérard Sirigu, Gien (FR); Pascal Rebillard, Gien (FR)

(73) Assignee: Otis Elevator Company, Farmington, CT (US)

( * ) Notice: Subject to any disclaimer, the term of this patent is extended or adjusted under 35 U.S.C. 154(b) by 593 days.

(21) Appl. No.: 12/305,785

(22) PCT Filed: Jun. 30, 2006

(86) PCT No.: PCT/IB2006/003103

§ 371 (c)(1),
(2), (4) Date: Dec. 19, 2008

(87) PCT Pub. No.: WO2008/004021

PCT Pub. Date: Jan. 10, 2008

(65) Prior Publication Data

US 2010/0163346 A1 Jul. 1, 2010

(51) Int. Cl.
*B66B 1/34* (2006.01)

(52) U.S. Cl. ..... 187/391; 187/302

(58) Field of Classification Search ..... 187/300, 187/301, 313, 316, 391–393
See application file for complete search history.

(56) References Cited

U.S. PATENT DOCUMENTS

| | | | | |
|---|---|---|---|---|
| 1,223,819 | A * | 4/1917 | Mitchell | 187/302 |
| 4,004,655 | A | 1/1977 | Kraft et al. | |
| 5,773,771 | A * | 6/1998 | Chatham | 187/282 |
| 6,202,797 | B1 * | 3/2001 | Skolnick et al. | 187/317 |
| 6,736,242 | B2 * | 5/2004 | Nygren | 187/357 |
| 7,278,517 | B2 * | 10/2007 | Gut | 187/300 |
| 7,533,763 | B2 * | 5/2009 | Kattainen et al. | 187/394 |
| 7,650,969 | B2 * | 1/2010 | Monzon et al. | 187/300 |
| 7,891,467 | B2 * | 2/2011 | Kattainen et al. | 187/394 |
| 2004/0222046 | A1 | 11/2004 | Gut | |

FOREIGN PATENT DOCUMENTS

| | | | |
|---|---|---|---|
| EP | 0985628 | A2 | 3/2000 |
| EP | 1110900 | A1 | 6/2001 |
| EP | 1118574 | A2 | 7/2001 |
| EP | 1319626 | A1 | 6/2003 |
| EP | 1422182 | A1 | 5/2004 |
| EP | 1440930 | A2 | 7/2004 |
| EP | 1674416 | A1 | 6/2006 |

(Continued)

*Primary Examiner* — Anthony Salata
(74) *Attorney, Agent, or Firm* — Carlson, Gaskey & Olds PC

(57) ABSTRACT

A safety device for an elevator system includes a retractable element mounted on a support. The retractable element has a stopping position in which a catch portion of the retractable element projects from the support to engage a triggering member of a safety brake associated with an elevator car as the elevator car traveling in a selected direction approaches a selected vertical position, and a retracted position. An actuator selectively controls the position of the retractable element. A position sensor is responsive to the position of the retractable element to make sure that it is in its stopping position when needed.

32 Claims, 6 Drawing Sheets

FOREIGN PATENT DOCUMENTS

| | | | |
|---|---|---|---|
| GB | 2158038 | A | 11/1985 |
| JP | HEI4199216472 | | 1/1992 |
| JP | 6107385 | A | 4/1994 |
| JP | 2002114462 | A | 4/2002 |
| WO | 2005026033 | A1 | 3/2005 |
| WO | 2005092774 | A1 | 10/2005 |
| WO | 2005105644 | A1 | 11/2005 |
| WO | 2005105645 | A1 | 11/2005 |
| WO | 2005121015 | A2 | 12/2005 |
| WO | 2006035264 | A1 | 4/2006 |
| WO | 2006062503 | A1 | 6/2006 |
| WO | 2006082461 | A1 | 8/2006 |

* cited by examiner

SAFETY DEVICE FOR SECURING MINIMUM SPACES AT THE TOP OR BOTTOM OF AN ELEVATOR SHAFT BEING INSPECTED, AND ELEVATOR HAVING SUCH SAFETY DEVICES

BACKGROUND OF THE INVENTION

The present invention relates to elevators. It applies, in particular, to elevators having a shallow pit and/or a low overhead.

Elevators with a shallow pit and/or a low overhead are advantageous because of the reduced impact of their installation on the construction cost and because of their compatibility with severe architectural constraints.

Machine room-less elevators have their drive system, in particular their motor and brake, located inside the volume of the elevator shaft. Access to these parts, and to other components fitted in the shaft is required for maintenance or repair purposes. Standards such as EN81 require safety clearances at the top and at the bottom of the shaft so that a person can enter a safe working space to have access to the machines and shaft components. Such working space can be located in the upper part of the hoistway, with the operator standing on top of the car, or in the pit at the bottom of the shaft.

Safety measures to make sure that the minimum safety volume is always achieved in an inspection operation have been proposed, in particular by taking advantage of the safety brake usually present in the elevator structure to prevent the car from traveling at an excessive speed. The safety brake is typically mounted on the car and cooperates with the fixed vertical guide rails to frictionally stop the car when triggered by a speed limiter cable or rope. US 2004/0222046 and WO 2006/035264 disclose devices for securing the protective space at the top or bottom of the shaft, including a fork element receiving the speed limiter cable. A bulging part is fixed on the cable to form an abutment caught by the fork element at a vertical position corresponding to the desired protective space, which triggers the safety brake. In a normal operation of the elevator, the fork element is retracted out of engagement with the limiter cable and the bulging part, so that the car can reach the uppermost or lowermost landing level unhindered. A spring mounting is provided for the fork element, so that when it catches the bulging part, it is allowed to move vertically for a certain distance needed for the safety brake to stop the car. The stroke of the spring mounting corresponding to such distance depends on the inertia of the car and counterweight and should typically be about 100 to 200 millimeters.

A problem with this kind of safety device is that the fork element may, for various reasons, become jammed and unexpectedly remain in the retracted position when an inspection operation is started. This creates a danger for the personnel entering the hoistway.

SUMMARY OF THE INVENTION

According to an embodiment of the invention, a safety device for an elevator system comprises:

- at least one retractable element mounted on a support, the retractable element having a stopping position in which a catch portion of the retractable element projects from the support to engage a triggering member of a safety brake associated with an elevator car as the elevator car traveling in a selected direction approaches a selected vertical position, and a retracted position;

- an actuator that selectively controls the position of the retractable element; and
- a position sensor responsive to the position of the retractable element.

The retractable element is typically deployed in an inspection operation, so as to project in the trajectory of the safety brake triggering member. Preferably, it does not form an obstacle to the triggering member as the car moves in the reverse direction.

The position sensor makes it possible to check that the retractable element is well deployed prior to allowing movement of the car in the inspection operation. This avoids the risk that a mechanic controlling an upward or downward movement of the car from inside the shaft may lose the protection afforded by the safety device.

In another embodiment of the invention, which may be implemented in combination with the above or separately, the safety device comprises:

- a bracket;
- a support carriage mounted on the bracket so as to slide along a vertical direction;
- at least two retractable elements mounted on the support carriage, each having a respective catch portion, the two retractable elements being vertically offset with a fixed distance therebetween, each retractable element having a stopping position in which the catch portion of said retractable element projects from the support carriage to engage a triggering member of a safety brake associated with an elevator car as the elevator car traveling in a selected direction approaches a respective vertical position, and a retracted position;
- a spring arrangement to accommodate a vertical sliding movement of the support carriage when the catch portion of one of the two retractable elements engages the triggering member of the safety brake; and
- actuators respectively associated with the retractable elements, each actuator selectively controlling the position of the respective retractable element.

An advantage of such a configuration of the safety device is that two levels of safety can be provided relatively close to each other for the same direction of travel of the car by means of two retractable elements. The spring arrangement allows the two elements to slide together along a relatively long stroke which may be needed for the safety brake to effectively stop the car, thus eliminating the problem that the support of one of the two elements may hinder the vertical sliding of the other element when it is hit by the triggering member of the safety brake.

The two levels of safety can for example include a first level corresponding to a minimum working space on top of the car (for example about 1.80 meters from the car roof to the shaft ceiling) and a second level corresponding to a ultimate safety volume (for example about 1 meter from the car roof to the shaft ceiling).

Another aspect of the present invention relates to an elevator comprising:

- a car movable vertically within an elevator shaft;
- an elevator control circuit for controlling movement of the car;
- a safety brake for stopping the car when triggered;
- at least one retractable element mounted on a support, the retractable element having a stopping position in which a catch portion of the retractable element projects from the support to engage a triggering member of the safety brake as the car traveling in a selected direction approaches a selected vertical position, and a retracted position;

an actuator that selectively controls the position of the retractable element; and a position sensor responsive to the position of the retractable element.

The actuator is advantageously controlled to put the retractable element in the stopping position when the elevator is in an inspection operation. The position sensor is coupled to the elevator control circuit to prevent movement of the car in the inspection operation when the retractable element is not in the stopping position.

The selected vertical position is for example adjacent a highest landing level of the car to provide a minimum safety volume at the top of the shaft when an upward movement of the car is stopped by the safety brake in response to engagement of the triggering member by the catch portion of the retractable element. Alternatively, it can be adjacent a lowest landing level of the car to provide the minimum safety volume at the bottom of the shaft when a downward movement of the car is stopped by the safety brake in response to engagement of the triggering member by the catch portion of the retractable element.

Another embodiment of an elevator according to the present invention comprises: a car movable vertically within an elevator shaft; a safety brake for stopping the car when triggered; and at least one safety device for triggering the safety brake in response to detection of the car traveling in a selected direction in an inspection operation. The safety device comprises:

a bracket fixed within the shaft;

a support carriage mounted on the bracket so as to slide along a vertical direction;

at least two retractable elements mounted on the support carriage, each having a respective catch portion, the two retractable elements being vertically offset with a fixed distance therebetween, each retractable element having a stopping position in which the catch portion of said retractable element projects from the support carriage to engage a triggering member of a safety brake associated with an elevator car as the elevator car traveling in the selected direction approaches a respective vertical position, and a retracted position;

a spring arrangement to accommodate a vertical sliding movement of the support carriage when the catch portion of one of the two retractable elements engages the triggering member of the safety brake; and actuators respectively associated with the retractable elements, each actuator selectively controlling the position of the respective retractable element.

DESCRIPTION OF PREFERRED EMBODIMENTS

Figure 1:
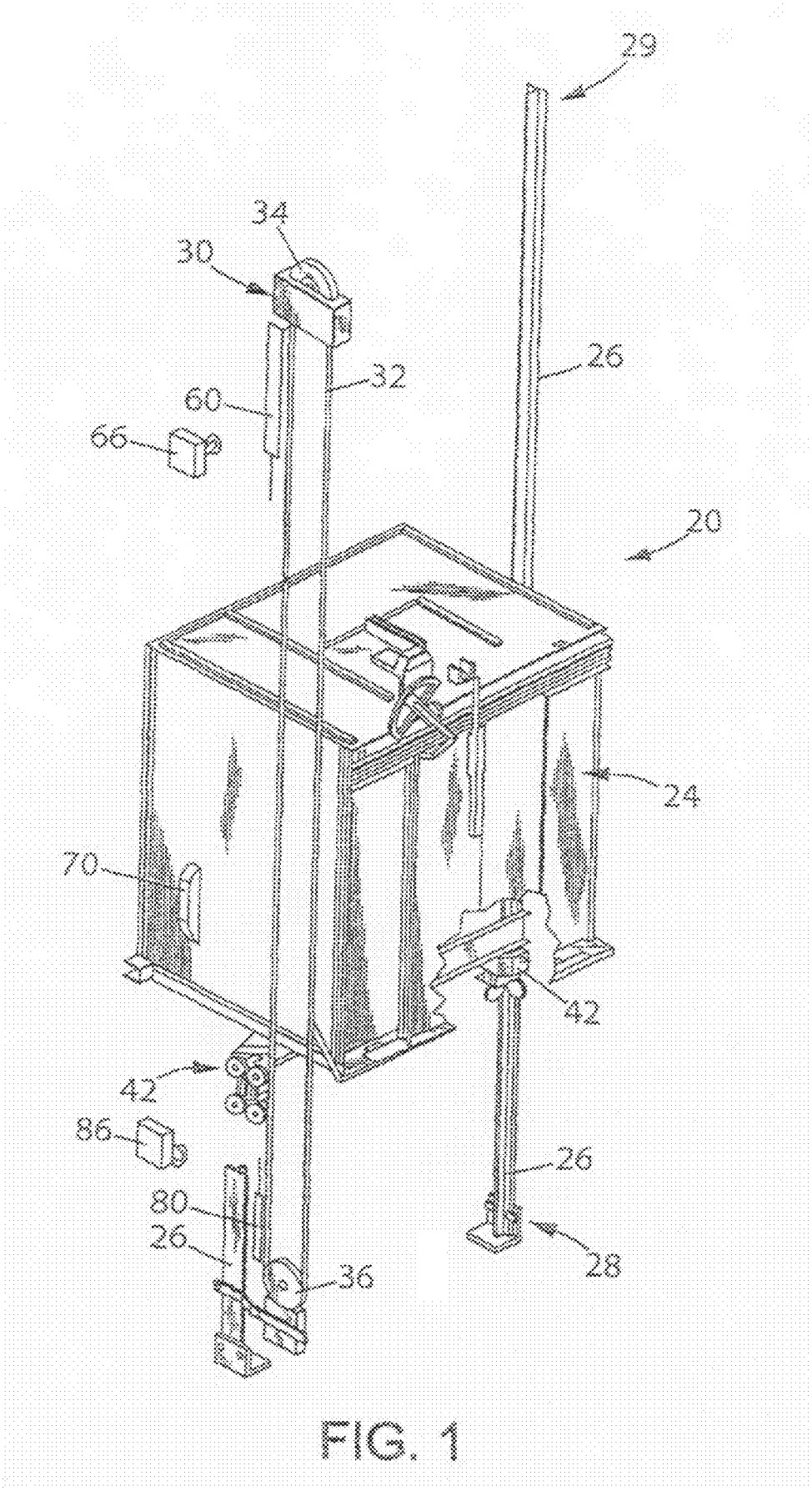
FIG. 1 schematically illustrates selected portions of an embodiment of an elevator to which the present invention is applicable.

FIG. 1 shows an elevator system 20 including an elevator car 24 that moves along guide rails 26 in a known manner.

In one example, a machine room-less elevator system allows the car 24 to move essentially along the entire length of a hoistway between a lower end 28 (i.e. a pit) and an upper end 29 of a hoistway. A drive system (not shown) including a motor and a brake is conventionally used to control the vertical movements of the car 24 along the hoistway via a traction system partly visible in FIG. 2, including cables or belts 25 and reeving pulleys 27.

In addition, a governor device 30 controls movement of the car 24 by preventing it from moving beyond a selected maximum speed. The example governor device 30 includes a governor rope 32 that travels with the car 24 as the car moves along the guide rails 26. A governor sheave 34 and a tension sheave 36 are at opposite ends of a loop followed by the governor rope 32.

The illustrated governor device 30 operates in a known manner. In the event that the car 24 moves too fast, the governor device 30 exerts a braking force on the governor sheave 34. That causes the governor rope 32 to pull upon a mechanical linkage to activate safety brakes 42 shown diagrammatically in FIG. 1. In this example, the safety brakes apply a braking force against the guide rails 26 to prevent further movement of the elevator car 24. A variety of safety brakes 42 for this purpose are known. Connecting rods may be arranged in a known manner above the car roof and/or below the car floor to synchronize the operation of safety brakes cooperating with respective guide rails disposed on both sides of the car.

Figure 2:
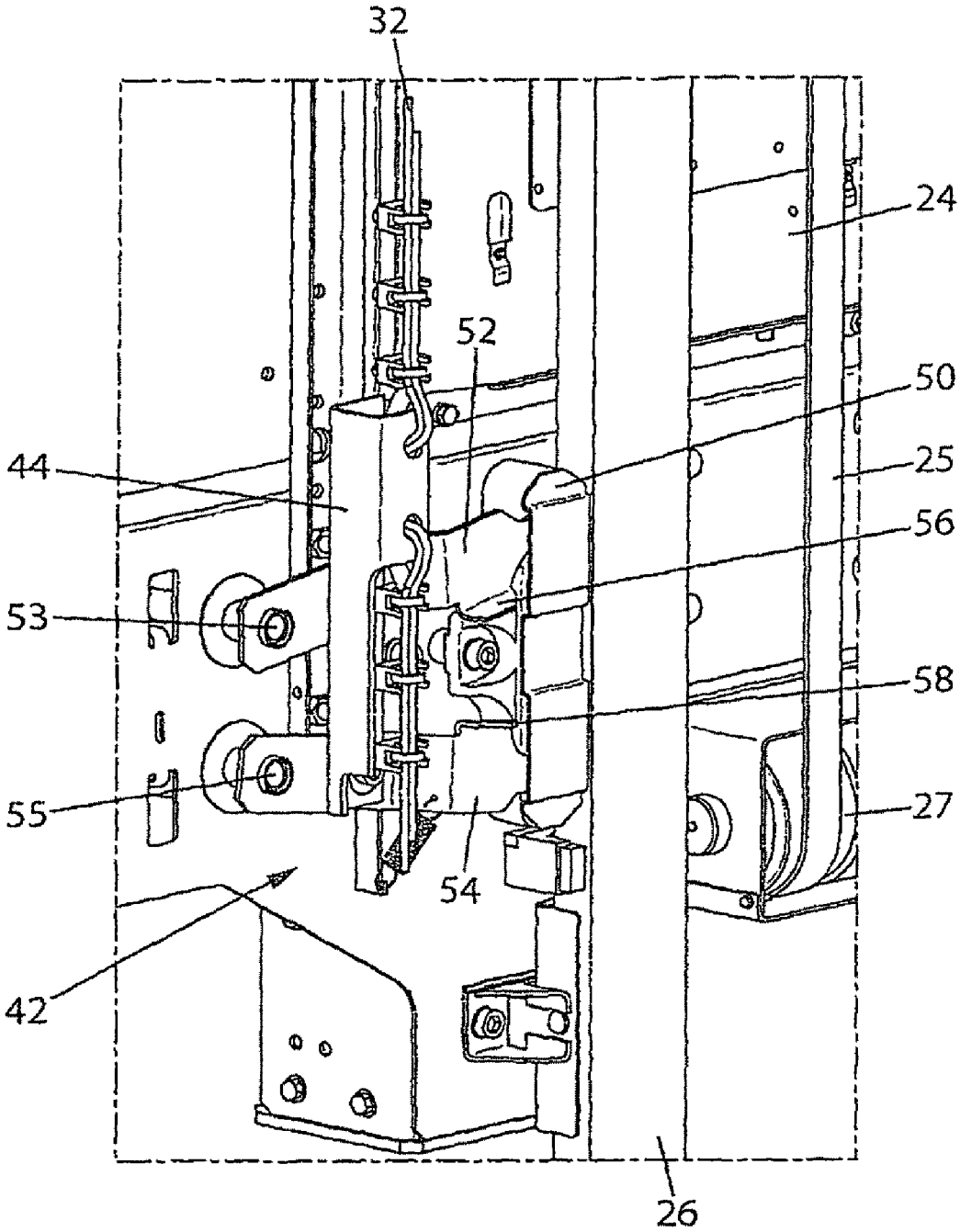
FIG. 2 is a perspective view of a safety brake usable in such an elevator.

FIG. 2 shows a possible arrangement of the safety brake 42. A safety gear 50 is fixed to the car structure so as to slide along the guide rail 26. Triggering of the gear 50 generates friction along the rail 26 and the gear is conventionally disposed to amplify the friction by a wedge action until the car is stopped. The exemplary safety brake shown in FIG. 2 has a dual action. It can be triggered either by an upper lever 52 to block upward movement of the car 24 or by a lower lever 54 to block downward movement of the car 24. Each triggering lever 52, 54 is articulated to the car structure about a respective pivot axis 53, 55. The governor rope 32 has its two ends attached to a linkage 44. The linkage 44 extends substantially vertically and is articulated to the two triggering levers 52, 54 in a middle portion of these levers. Hence, when the governor rope 32 is retained due to an overspeed condition while the car 24 moves downwards (upwards), the lower lever 54 (upper lever 52) is pulled by the rope 32 to trigger the safety gear 50 and stop the car 24.

In addition, the triggering levers 52, 54 shown in FIG. 2 have lateral extensions 56, 58 between the safety gear 50 and the articulation of the pulling rod 44. The lateral extensions 56, 58 project outwardly to interact with safety devices described further below.

The arrangement of FIG. 1 includes two safety devices 60, 80 positioned at selected heights within the hoistway. The safety devices 60, 80 interact with at least one of the safety brakes 42 under selected conditions to prevent the car assembly 24 from moving too close to the upper end 29 of the hoistway and too close to the lower end 28 of the hoistway, respectively. If needed, other such devices may be strategically placed within the hoistway. Given this description, those skilled in the art will realize how many of such devices are desirable and will be able to select an appropriate location for them to meet the needs of their particular situation.

While the governor device 30 operates depending on a speed of elevator car movement, the safety devices 60, 80 operate depending on the vertical position of the elevator car 24.

Figure 3:
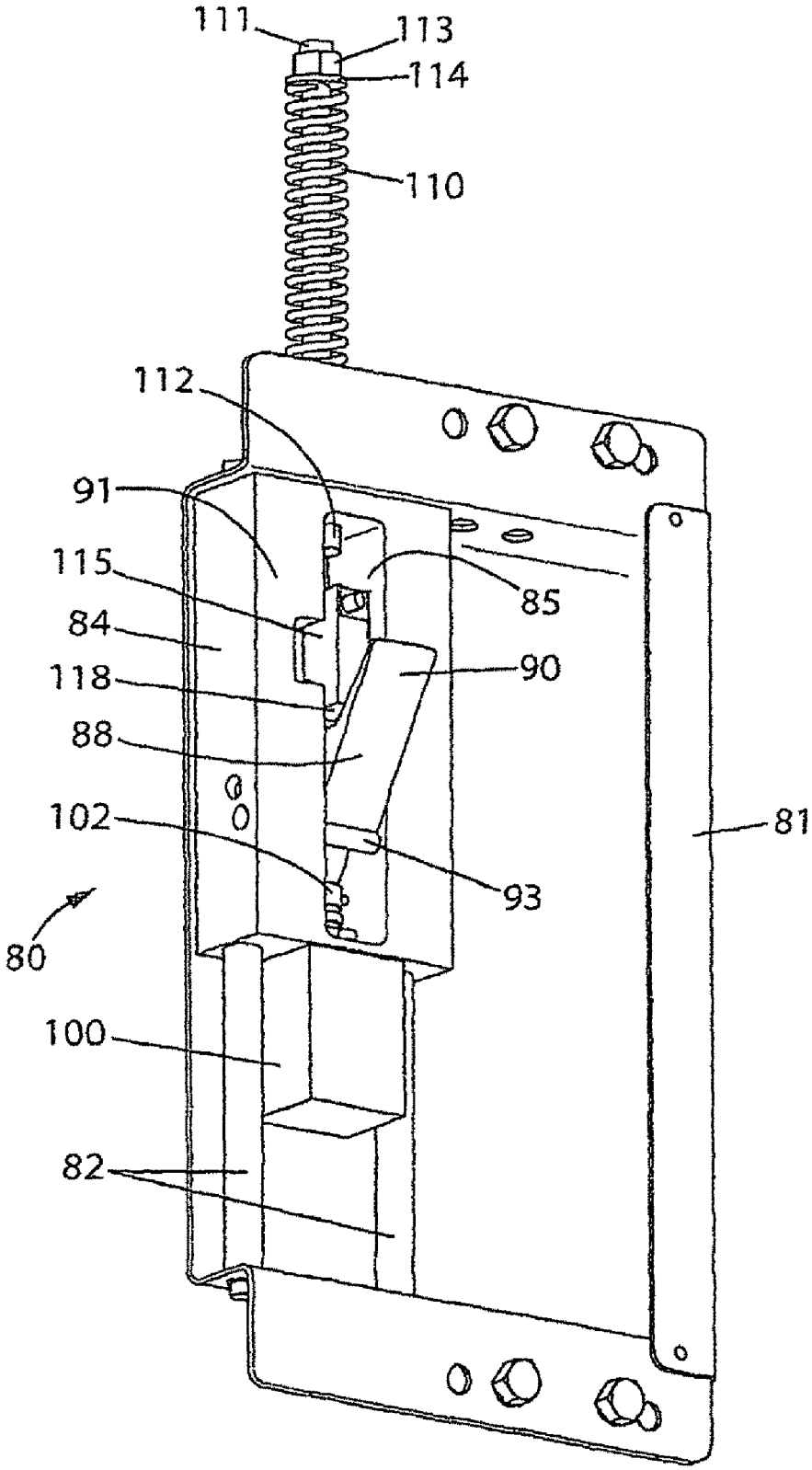
FIG. 3 is a perspective view of an embodiment of a safety device according to the invention.
Figure 4:
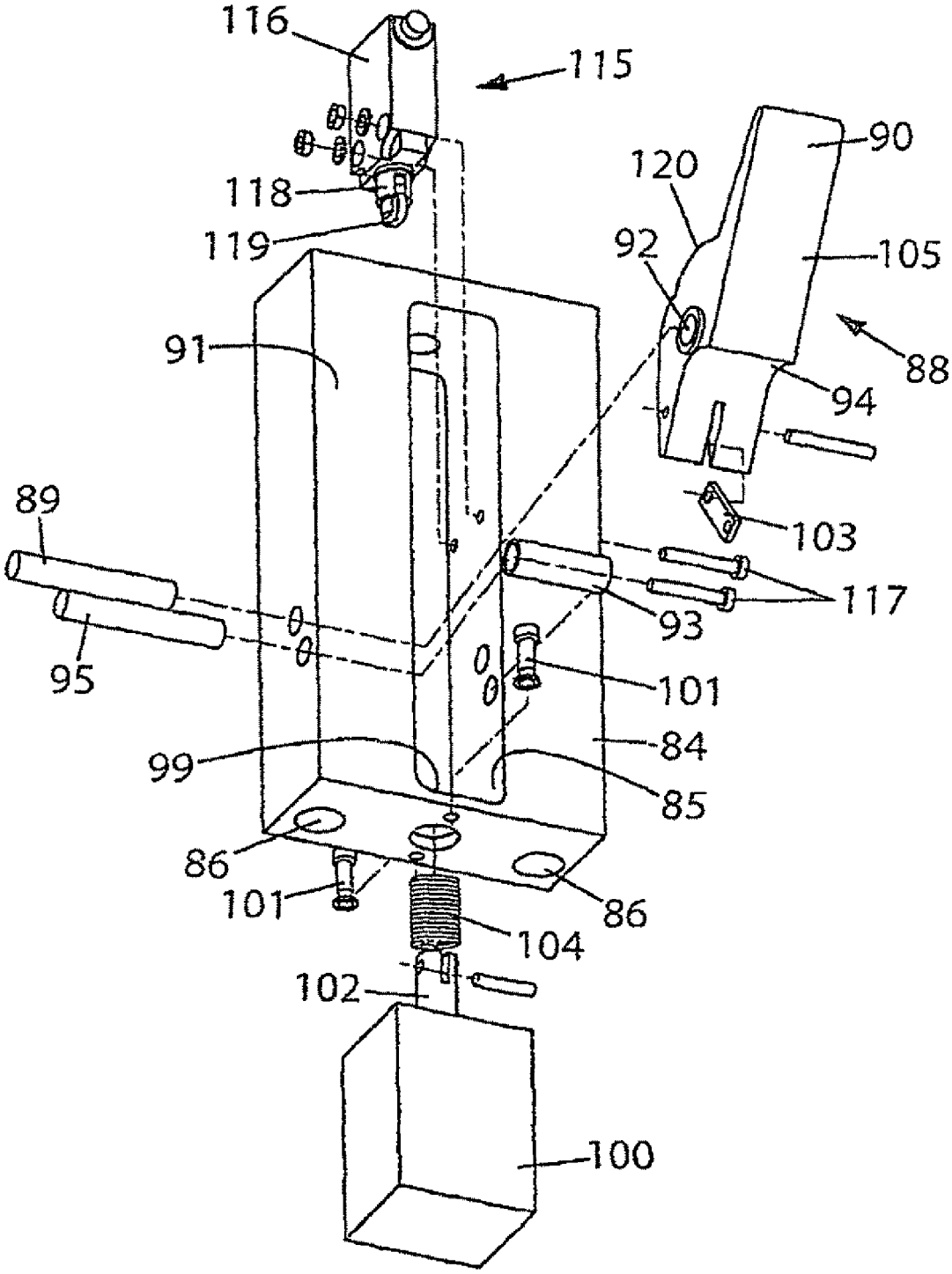
FIG. 4 is an exploded view of part of the safety device of FIG. 3.

An example of lower safety device 80 is shown in FIG. 3. This example includes a bracket 81 to be fixed, at the selected height, to a guide rail 26 or to the shaft wall close to the guide rail 26. The bracket 81 has vertical guide rods 82 for slidably receiving a movable assembly or carriage whose components are shown in FIG. 4. The movable assembly includes a support block 84 formed with a vertical, longitudinal slot 85 in its center. On both sides of the slot 85, two cylindrical through holes 86 receive the guide rods 82.

A retractable stopping element 88 is pivotally mounted within the central slot 85 about a horizontal pivot axis 89. The stopping element 88 has a catch portion 90 which projects from the front surface 91 of the support block 84 when deployed in the stopping position shown in FIG. 3. The center of gravity of the retractable stopping element 88 is located in front of the cylindrical bore 92 receiving the pivot axis 89, so that the element 88 naturally falls into its stopping position. In that position, the lower surface 94 of the stopping element 88 rests on an abutment extending across the slot 85. In the example, the abutment consists of a sleeve 93 held within the slot by a horizontal pin 95.

An actuator 100 is fixed by screws 101 at the lower end of the support block 84. The actuator 100 has an arm 102 which extends through the lower part 99 of the block 84 into the slot 85. A connecting rod 103 is articulated between the tip of actuator arm 102 and the lower end of the retractable element 88. A helical spring 104 is disposed around the actuator arm 102 between the lower part 99 of the block 84 and the pin holding the connecting rod 103 on the actuator arm 102. The spring 104 is compressed to urge the element 88 towards its stopping position. The actuator 100 includes an electromagnet which is powered by the elevator control circuitry in selected circumstances. When powered, the electromagnet pulls the actuator arm 102 to bring the element 88 into its retracted position in which its front surface 105 comes approximately flush with the front surface 91 of the support block 84. In this retracted position, the element 88 does not interfere with the safety brake triggering levers 52, 54.

In the stopping position of the retractable element 88, the catch portion 90 lies in the trajectory of the lateral extension 58 of the lower triggering lever 54 of the safety brake. If the car 24 traveling downwards reaches the level of the lower safety device 80 in its stopping position, the catch portion 90 of element 88 bearing on the abutment 93 lifts the triggering lever 54 to stop the car.

If the car 24 comes from the bottom of the pit and moves upwards, the lateral extensions 56, 58 of the safety brake triggering levers engage the front surface 105 of the retractable stopping element 88. Since the weight of the element 88 and the strength of spring 104 are low compared to the force needed to trigger the safety brake 42, the stopping element 88 is pushed towards its retracted position and the car can continue its upward travel. Gravity and the action of spring 104 immediately bring element 88 back to its stopping position.

A spring arrangement is provided to mount the support block 84 on the bracket 81 of the safety device 80. This arrangement accommodates a vertical sliding movement of the support block 84 when the safety device 80 triggers the safety brake 42, thus accounting for the distance needed for the safety brake to completely stop the car.

In the embodiment shown, the spring arrangement includes a helical spring 110 mounted around a cylindrical rod 111. The rod 111 has a threaded end portion which extends through a hole provided in the upper end of the support block 84 and through a corresponding hole provided in the upper part of the bracket 81. A bolt 112 is screwed on this threaded end portion within the slot 85 to attach the rod 111 to the support block 84. The opposite end of the rod 111 is also threaded to receive another bolt 113 and a washer 114. The helical spring 110 is compressed between the upper part of the bracket 81 and the washer 114, which maintains the support block in the upper position shown in FIG. 3 as long as the retractable element 88 is not hit by the safety brake triggering lever. The spring 110 is so designed that its strength is sufficient to cause the triggering of the safety brake when the element 88 catches the lever 54 and its stroke is at least equal to the maximum distance needed to stop the car by the safety brake. A typical requirement for such a stroke is about 200 mm.

The safety device 80 is also fitted with a position sensor 115 of which an exemplary embodiment is shown in FIGS. 3-4. In this embodiment, the sensor 115 includes a housing 116 attached to the support block 84 within the slot 85 by means of screws 117. A switch located within the housing 116 has its state controlled by the position of a retractable arm 118 having a roller 119 mounted at its distal end. The arm 118 is biased towards its extended position and the roller 119 follows a cam surface 120 provided on the rear side of the retractable stopping element 88. Accordingly, the sensor switch is closed when the retractable element 88 is fully deployed in its stopping position, and otherwise open.

The safety device 80 described above in relation to its positioning near the bottom of the pit to stop the car traveling downwards (shallow pit configuration) can be used symmetrically near the top of the shaft to stop the car traveling upwards in a low overhead configuration. It suffices to install the device upside-down as compared to what has been previously described (see the positioning of device 60 diagrammatically shown in FIG. 1).

Since the safety brake 42 is not easily released once activated, it is not desired to actuate it via one of the safety devices 60, 80 when an inspection operation is carried out without any failure or abnormal situation. Upper and lower limit switches 66, 86 (FIG. 1) are preferably installed near the safety devices 60, 80 to be primarily used to stop the car at the ends of the inspection travel, the safety devices 60, 80 being used as backup to provide an additional level of safety if an anomaly occurs.

To secure a convenient working space on top of the car for a mechanic to have access to machinery installed on top of the shaft, an interval of about 1,800 to 2,000 mm from the car roof to the shaft ceiling is needed. The upper limit switch 66 is disposed at a corresponding level in the shaft (adjacent to the highest landing level), to be opened by a cam surface 70 mounted on the car structure when the car reaches a vertical level corresponding to such an interval. Opening of switch 66 in an upward inspection travel causes the car to so be stopped by the electrically-controlled brake of the drive system. Likewise, the lower limit switch 86 is positioned to be opened by the cam surface 70 (or another cam) mounted on the car structure when the car reaches a vertical level adjacent to the lowest landing level which leaves a working space whose height is about 1,800 to 2,000 mm above the pit floor. Opening of switch 86 in a downward inspection travel causes the car to be stopped by the electrically-controlled brake.

If, for any reason, the car moving upwards (downwards) in an inspection operation unexpectedly exceeds the level of the upper (lower) limit switch 66 (86) by more than the maximum stopping distance of the car with the electrically-controlled brake, the safety device 60 (80) located just after the limit switch may come into play to safely stop the car 24 by means of the safety brake 42.

It is sometimes useful to provide two levels of safety relatively close to each other for stopping the car traveling in a given direction. This can typically occur near the top of the shaft in a low overhead configuration (in a shallow pit configuration the presence of a toe guard may make this feature unnecessary as those skilled in the art will appreciate from the following discussion). If a first safety device as described hereabove is provided just above the car level associated with the upper limit switch 66, at a distance sufficient for the car to be normally stopped by the electromagnetic brake without hitting the stopping element 88, an interval of about 1,400 to 1,700 mm between the car roof and the shaft ceiling is left when the car is stopped on this first safety device.

Access to the car roof is typically performed by manually opening a landing door with a special key, which opens a switch to break the safety chain and stop the car by means of the drive system. The mechanic can then clamber on top of the car to carry out the required maintenance or repair operations. It can happen that someone manually opens the door of the highest landing level while the car is located just above the vertical position corresponding to the first safety device, for example with an interval of about 1,600 mm between the car roof and the shaft ceiling. With a low overhead elevator configuration, the distance between the shaft ceiling and the upper lintel of the highest landing door may be of, e.g., about 500 to 700 mm which means, in our example, that a gap of about 1000 mm or more may remain above the car roof while the landing door is open and the car has been stopped above the positions of both the switch and the safety device. This is sufficient for the mechanic to climb on top of the car or for an intruder to sneak in. If this occurs, such a person has no more mechanical protection against a further upper movement of the elevator car.

It may thus be useful to provide a second level of safety by installing two successive safety devices both oriented to stop upward travel of the car. The uppermost device secures an ultimate safety volume complying with the minimum safety volume specified in the relevant standard such as EN-81. The distance between the car roof and the shaft ceiling while the upper triggering lever 52 hits the retractable element of the upper safety device is for example of about 1,000 mm, so that after the safety brake has stopped the car, the gap between the car roof and the upper lintel of the highest landing door has a height of about 300 mm, insufficient for someone to enter the shaft.

The two retractable stopping elements located adjacent the highest landing level to maintain the working and ultimate safety volumes above the car are vertically offset with a fixed distance of about 800 mm between them. A problem arises that such a distance may be too small to arrange in series two safety devices as described with reference to FIGS. 3-4. The dimension of the spring 110 is substantial because it is a strong spring (to effectively trigger the safety brake 42) with a long stroke of about 200 mm. If we also take into account the dimensions of the support block 84 and of the bracket 81, whose construction must be robust, we see that the dimensional constraints may prevent from arranging a series of two safety devices to provide the desired stopping levels.

Figure 5:
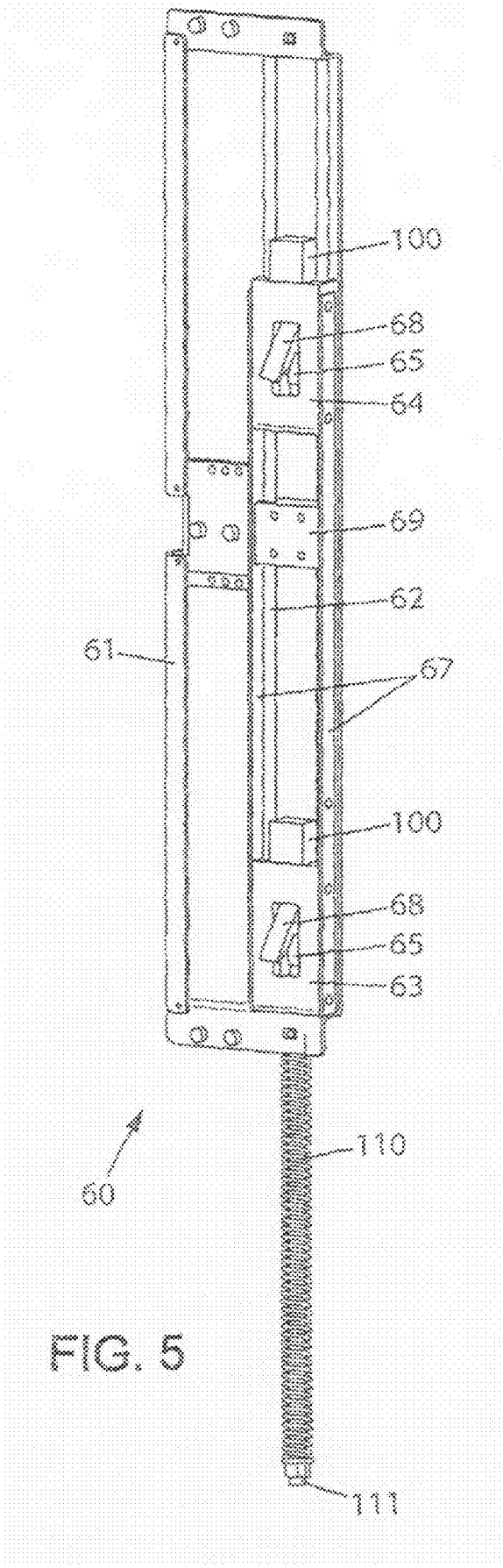
FIG. 5 is a perspective view of another embodiment of a safety device according to the invention.

To circumvent this problem, an arrangement of the safety device 60 such as the one shown by way of example in FIG. 5 may be used.

In this embodiment, the safety device 60 has one bracket 61 with two sliding support blocks 63, 64 mounted thereon. The two support blocks 63, 64 are connected together by lateral stringers 67 to form a rigid carriage supporting the two retractable stopping elements 68, each received in a vertical slot 65 of a respective support block 63, 64. As in the previously described embodiment, each support block is fitted with an electromagnetic actuator 100 and with a position sensor mounted in slot 65. It will be appreciated that, as an alternative to the two support blocks 63, 64 connected together by stringers to form a carriage, it is possible to provide the support carriage as one block carrying the two retractable stopping elements 68.

The support carriage 63, 64, 67 is slidably mounted on the vertical guide rods 62 whose central portion can be maintained in place by means of a plate 69 fixed to the bracket 61. The lower part of the support carriage is connected to the rod 111 which guides the compression spring 110. This spring 110 can have the length required both to be strong enough to withstand the impact of the safety brake triggering lever on any of the two stopping elements 68 and to be contracted by at least the maximum stopping distance of the car 24 with the safety brake 42 without interfering with another component of the elevator system. The spring 110 accommodates the vertical sliding movement of the support carriage and of the two retractable elements 68 when the catch portion of one of these two elements engages the triggering member of the safety brake. Its stroke is preferably greater than one tenth of the fixed distance between the two retractable elements. When this distance is 800 mm, it means that the stroke is at least 80 mm. A typical value is about 200 mm.

Figure 6:
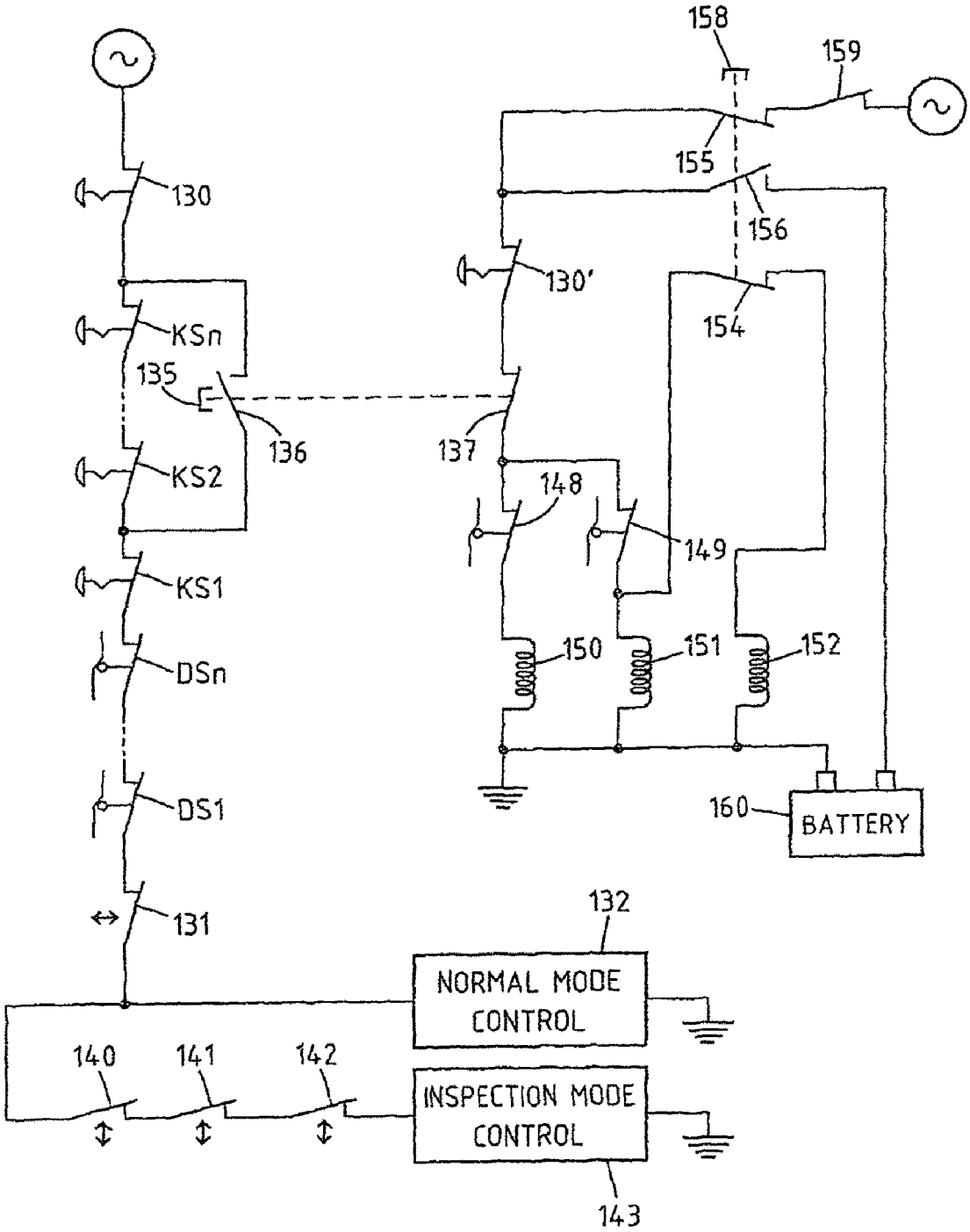
FIG. 6 is a diagram of an example of electrical circuit used in an embodiment of an elevator according to the invention.

FIG. 6 shows an embodiment of an electric circuit usable in an elevator having n landing levels, a single level safety device 80 as shown in FIG. 3 near the lowest landing level and a double level safety device 60 as shown in FIG. 5 near the highest landing level. Power supply to the motor and brake of the drive system is made from an AC source such as the mains via a safety chain including a number of series-connected switches. When the brake is not powered, it is in a state which blocks the motor axle to stop the car. When all the series-connected switches are closed, the elevator is considered to be in a safe condition: the motor can be energized and the brake can be released. The safety chain includes a branch for controlling normal operation of the elevator and a branch for controlling inspection operation. These two branches have a number of switches in common including, in a non-limiting manner:

- one or more emergency switches 130 which an operator may open manually in case of danger;
- n bi-stable key switches KS1-KSn coupled with safety locks mounted on the upper lintels of the n landing doors. Each safety lock is operated with a special key such as a triangle key when someone needs to have access to the elevator shaft. Manual opening of the landing door of level i using the special key opens the corresponding key switch KSi, which can only be closed once the door of level i is closed and the safety lock brought back to its locking position by means of the key. An example of such safety lock fitted with a bi-stable switch is disclosed in international patent application No. PCT/IB05/000276;
- n switches DS1-DSn respectively associated with the n landing doors, the switch DSi being closed under the condition that the landing door of level is completely closed;
- a switch 131 which is opened upon triggering of the safety brake 42.

Switching from the normal mode of operation to the inspection mode is made by pushing a mode button 135 which, in the example considered here, is located on the car roof. Mode button 135 controls the positions of two inspection operation switches 136, 137 so that switch 136 is closed and switch 137 is open when the inspection mode of operation is selected. Inspection operation switch 136 is connected in parallel with the series of the n−1 key switches KS2-KSn associated with the safety locks of all the landing doors but the lowest. These n−1 landing doors are those from which access to the car roof is possible. The bi-stable switch KS1 of the lowest landing level is connected in series with the n−1 other bi-stable switches KS2-KSn and with the branch including the inspection operation switch 136.

Key switches KS2-KSn are used as detectors of someone's presence on the car roof. When a landing door is opened by means of the special key, it is assumed that someone has clambered on top of the car so that normal operation is prevented. Inspection operation can take place, but only after the mechanic actuates the mode button 135 on top of the car. In any event, car movement in normal mode will only be possible after the mechanic checks out with the triangle key by operating the safety lock of the door by which he entered the hoistway.

The normal operation branch may include other switches of the safety chain, depicted diagrammatically by block 132 in FIG. 6. The inspection operation branch includes the series-connected switches 140, 141, 142 of the three position sensors 115 belonging to the two safety devices 60, 80 and possibly other switches depicted diagrammatically by block 143 in FIG. 6. Therefore, a car movement in the inspection mode is enabled if all the three retractable stopping elements of the safety devices are in their stopping positions, and prevented otherwise.

The coils 150, 151, 152 of the electromagnetic actuators 100 of the three retractable stopping elements are supplied with power from an AC source which may be the same source as for the safety chain or another source. The coil 150 of the lower safety device 80 is connected in series with a switch 148 is positioned within the shaft to cooperate with the cam surface 70 mounted on the car structure or another cam. Switch 148 is open unless the car 24 is located under a level near and above the lowest landing level. Switch 148 is for example collocated with the lower limit switch 86 and open when switch 86 is closed and vice versa. It can also be located slightly above switch 86. Due to switch 148, the stopping element 88 of the safety device 80 cannot be retracted unless the car comes close to the pit, thus enabling the car to reach the lowest landing level in a normal operation.

Likewise, the coil 151 actuating the lower stopping member 68 of the upper safety device 60 is connected in series with a switch 149 so positioned in the shaft that this stopping element 68 cannot be retracted unless the car comes relatively close to the shaft ceiling. Switch 149 is open unless the car 24 is located above a level near and below the highest landing level. Switch 149 is for example collocated with the upper limit switch 66 and open when switch 66 is closed and vice versa. It can also be located slightly below switch 66. The switch 149 enables the car 24 to reach the highest landing level in a normal operation. The coil 152 actuating the upper stopping member of the upper safety device 60 is also connected in series with the switch 149 unless another switch 154 is open in a manual rescue operation (MRO).

The two switches 148, 149 are connected to the inspection operation switch 137 to prevent the retraction of the stopping elements 68, 88 in the inspection mode. One or more emergency switches 130' which an operator may open manually if necessary can be connected in series with the inspection operation switch 137 to make sure that the retractable stopping elements remain deployed if a dangerous condition is signaled.

FIG. 6 also shows a battery 160 which can be used to energize the coils 150-151 in MRO mode. This mode is selected by means of a button or other control member when it is necessary to evacuate the elevator. Activation of the MRO button 158 opens the above-mentioned switch 154 and a second switch 155 and closes a third switch 156. The battery 160 has a terminal connected to the coils 150-152 and its other terminal connected to the emergency switch 130' via switch 156 which is closed only when the MRO mode is selected. Therefore, in MRO mode, the ultimate safety volume is always preserved at the top of the shaft since coil 152 is deactivated. This does not prevent people from being evacuated from the car, but it avoids danger for a person which may happen to be on the car roof at the time of selecting the MRO mode. In MRO mode, coil 150 is energized when its associated switch 148 is closed because the car 24 has moved close to the pit, at or below the vertical position associated with switch 148. Likewise, coil 151 is energized when its associated switch 149 is closed because the car 24 has moved close to the shaft ceiling, at or above the vertical position associated with switch 149. Thus, the working spaces defined by the stopping elements controlled by coils 150 and 151 are not always preserved in MRO mode, which can be helpful to evacuate the elevator car at the lowest or highest landing level.

When the MRO mode is not selected, switch 155 is closed so that AC power can be supplied to the coils 150-152 via an additional switch 159 which belongs to a relay associated with the normal operation control module 132. The relay switch 159 is closed when the normal operation is enabled, the elevator condition being detected as safe. This controls the normal behavior of the retractable stopping elements 68, 88 which are only retracted when the car comes close to them in the normal operation of the elevator.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

The invention claimed is:

1. A safety device for an elevator system, comprising:

at least one retractable element mounted on a support, the retractable element having a stopping position in which a catch portion of the retractable element projects from the support to engage a triggering member of a safety brake associated with an elevator car as the elevator car traveling in a selected direction approaches a selected vertical position, and a retracted position;

an actuator that selectively controls the position of the retractable element; and a position sensor responsive to the position of the retractable element, wherein the actuator is controlled to put the retractable element in the stopping position when the elevator is in an inspection operation, and the position sensor is coupled to an elevator control circuit to prevent movement of the car in the inspection operation when the retractable element is not in the stopping position.

2. The safety device as claimed in claim 1, wherein the position sensor comprises a switch which is in a closed state only when the retractable element is in the stopping position.

3. The safety device as claimed in claim 1, wherein the retractable element is arranged to be pushed away from the stopping position when the triggering member hits the catch portion while the car travels in a reverse direction with respect to said selected direction.

4. The safety device as claimed in claim 3, wherein the actuator is arranged to urge the retractable element into the retracted position when activated, and wherein the retractable element is pivotally mounted on the support about a pivot axis so positioned that the retractable element takes the stopping position by gravity when the actuator is deactivated.

5. The safety device as claimed in claim 4, comprising a spring urging the retractable element towards the stopping position.

6. The safety device as claimed in claim 1, further comprising:

a bracket on which the support is slidably mounted; and at least one spring arranged to accommodate a vertical sliding movement of the support and of the retractable element mounted thereon when the catch portion engages the triggering member of the safety brake.

7. The safety device as claimed in claim 6, comprising two retractable elements each having a stopping position and a retracted position, the two retractable elements being vertically offset with a fixed distance therebetween, and wherein the at least one spring is arranged to accommodate a vertical sliding movement of both retractable elements when the catch portion of one of the two retractable elements engages the triggering member of the safety brake.

8. The safety device as claimed in claim 7, wherein the at least one spring has a stroke greater than one fifth of the fixed distance between the two retractable elements.

9. A safety device for an elevator system, comprising:

a bracket;

a support carriage mounted on the bracket so as to slide along a vertical direction;

at least two retractable elements mounted on the support carriage, each having a respective catch portion, the two retractable elements being vertically offset with a fixed distance therebetween, each retractable element having a stopping position in which the catch portion of said retractable element projects from the support carriage to engage a triggering member of a safety brake associated with an elevator car as the elevator car traveling in a selected direction approaches a respective vertical position, and a retracted position;

a spring arrangement to accommodate a vertical sliding movement of the support carriage when the catch portion of one of the two retractable elements engages the triggering member of the safety brake; and actuators respectively associated with the retractable elements, each actuator selectively controlling the position of the respective retractable element.

10. The safety device as claimed in claim 9, wherein each retractable element is associated with a respective position sensor comprising a switch which is in a closed state only when the respective retractable element is in the stopping position, and wherein an elevator control circuit prevents movement of the elevator car in an inspection mode when either of the switches is in an open state.

11. The safety device as claimed in claim 10, wherein the switches of the position sensors are connected in series.

12. The safety device as claimed in claim 9, wherein each retractable element is arranged to be pushed away from the stopping position when the triggering member hits the catch portion of said retractable element while the car travels in a reverse direction with respect to said selected direction.

13. The safety device as claimed in claim 12, wherein each actuator is arranged to urge the respective retractable element into the retracted position when activated, and wherein said retractable element is pivotally mounted on the support about a pivot axis so positioned that said retractable element takes the stopping position by gravity when said actuator is deactivated.

14. The safety device as claimed in claim 13, comprising springs urging the retractable elements towards the stopping position.

15. The safety device as claimed in claim 9, wherein the spring arrangement has a stroke greater than one fifth of the fixed distance between the two retractable elements.

16. The safety device as claimed in claim 9, wherein the spring arrangement comprises a spring mounted around a rod connected to the support carriage, the spring having a first end bearing against an abutment near an end of the rod and a second end bearing against the bracket at a location between the support carriage and said end of the rod.

17. An elevator comprising:

a car movable vertically within an elevator shaft;

an elevator control circuit for controlling movement of the car;

a safety brake for stopping the car when triggered;

at least one retractable element mounted on a support, the retractable element having a stopping position in which a catch portion of the retractable element projects from the support to engage a triggering member of the safety brake as the car traveling in a selected direction approaches a selected vertical position, and a retracted position;

an actuator that selectively controls the position of the retractable element; and a position sensor responsive to the position of the retractable element, wherein the actuator is controlled to put the retractable element in the stopping position when the elevator is in an inspection operation, and the position sensor is coupled to the elevator control circuit to prevent movement of the car in the inspection operation when the retractable element is not in the stopping position.

18. The elevator as claimed in claim 17, wherein the selected vertical position is adjacent a highest landing level of the car to provide a minimum safety volume at the top of the shaft when an upward movement of the car is stopped by the safety brake in response to engagement of the triggering member by the catch portion of the retractable element, or adjacent a lowest landing level of the car to provide a minimum safety volume at the bottom of the shaft when a downward movement of the car is stopped by the safety brake in response to engagement of the triggering member by the catch portion of the retractable element.

19. The elevator as claimed in claim 17, wherein the retractable element is arranged to be pushed away from the stopping position when the triggering member hits the catch portion while the car travels in a reverse direction with respect to said the selected direction.

20. The elevator as claimed in claim 17, wherein the actuator is arranged to urge the retractable element into the retracted position when activated, the elevator further comprising a sensor responsive to the vertical position of the car in a normal operation to selectively activate the actuator when the car is located in a vertical range including a highest landing level if the selected vertical position is adjacent the highest landing level and including the lowest landing level if the selected vertical position is adjacent the lowest landing level.

21. The elevator as claimed in claim 17, further comprising:

a bracket on which the support is slidably mounted; and at least one spring arranged to accommodate a vertical sliding movement of the support and of the retractable element mounted thereon when the catch portion engages the triggering member of the safety brake.

22. The elevator as claimed in claim 21, comprising two retractable elements each having a stopping position and a retracted position, the two retractable elements being vertically offset with a fixed distance therebetween, and wherein the at least one spring is arranged to accommodate a vertical sliding movement of both retractable elements when the catch portion of one of the two retractable elements engages the triggering member of the safety brake.

23. The elevator as claimed in claim 22, wherein the at least one spring has a stroke greater than one fifth of the fixed distance between the two retractable elements.

24. An elevator comprising:

a car movable vertically within an elevator shaft;

a safety brake for stopping the car when triggered; and at least one safety device for triggering the safety brake in response to detection of the car traveling in a selected direction in an inspection operation, wherein the safety device comprises:

a bracket fixed within the shaft;

a support carriage mounted on the bracket so as to slide along a vertical direction;

at least two retractable elements mounted on the support carriage, each having a respective catch portion, the two retractable elements being vertically offset with a fixed distance therebetween, each retractable element having a stopping position in which the catch portion of said retractable element projects from the support carriage to engage a triggering member of a safety brake associated with an elevator car as the elevator car traveling in the selected direction approaches a respective vertical position, and a retracted position;

a spring arrangement to accommodate a vertical sliding movement of the support carriage when the catch portion of one of the two retractable elements engages the triggering member of the safety brake; and actuators respectively associated with the retractable elements, each actuator selectively controlling the position of the respective retractable element.

25. The elevator as claimed in claim 24, wherein the actuators are controlled to put the retractable elements in the stopping position when the elevator is in the inspection operation, wherein each retractable element is associated with a respective position sensor coupled to an elevator control circuit to prevent movement of the car in the inspection operation when the retractable element is not in the stopping position.

26. The elevator as claimed in claim 25, wherein each of said position sensors comprises a switch which is in a closed state only when the respective retractable element is in the stopping position, and wherein the switches of the position sensors are connected in series in a safety chain used to supply power to the elevator control circuit in the inspection operation.

27. The elevator as claimed in claim 24, wherein the selected vertical positions comprise:

a first vertical position associated with a first one of the retractable elements, the first vertical position being adjacent a highest landing level of the car to provide a working space at the top of the shaft when an upward movement of the car is stopped by the safety brake in response to engagement of the triggering member by the catch portion of the first retractable element; and a second vertical position associated with a second one of the retractable elements, the second vertical position being located at said fixed distance above the first vertical position to provide a ultimate safety volume at the top of the shaft when an upward movement of the car is stopped by the safety brake in response to engagement of the triggering member by the catch portion of the second retractable element.

28. The elevator as claimed in claim 27, wherein the actuators are arranged to urge the respective retractable elements into the retracted position when activated, and wherein, in a manual rescue operation, the actuator associated with the first retractable element is activated at least when the car is above a predetermined vertical position while the actuator associated with the second retractable element is deactivated.

29. The elevator as claimed in claim 27, wherein each retractable element is arranged to be pushed away from the stopping position when the triggering member hits the catch portion of said retractable element while the car travels in a reverse direction with respect to said the selected direction.

30. The elevator as claimed in claim 29, wherein the actuators are arranged to urge the retractable elements into the retracted position when activated, the elevator further comprising a sensor responsive to the vertical position of the car in a normal operation to selectively activate the actuators when the car is located in a vertical range including the highest landing level.

31. The elevator as claimed in claim 24, wherein the spring arrangement has a stroke greater than one fifth of the fixed distance between the two retractable elements.

32. The elevator as claimed in claim 24 wherein the spring arrangement comprises a spring mounted around a rod connected to the support carriage, the spring having a first end bearing against an abutment an end of the rod and a second end bearing against the bracket at a location between the support carriage and said end of the rod.

* * * * *